US008840159B2

(12) United States Patent
Karlsson

(10) Patent No.: US 8,840,159 B2
(45) Date of Patent: Sep. 23, 2014

(54) CABLE-CONTROLLED CONTAINER YOKE

(75) Inventor: Gösta Karlsson, Killeberg (SE)

(73) Assignee: ELME Spreader AB, Älmhult (SE)

( * ) Notice: Subject to any disclaimer, the term of this patent is extended or adjusted under 35 U.S.C. 154(b) by 0 days.

(21) Appl. No.: 13/521,196

(22) PCT Filed: Jan. 12, 2011

(86) PCT No.: PCT/SE2011/050026
§ 371 (c)(1),
(2), (4) Date: Jul. 9, 2012

(87) PCT Pub. No.: WO2011/093768
PCT Pub. Date: Aug. 4, 2011

(65) Prior Publication Data

US 2012/0306223 A1 Dec. 6, 2012

(30) Foreign Application Priority Data

Jan. 14, 2010 (SE) ..... 1050028

(51) Int. Cl.
*B66C 1/00* (2006.01)
*B66C 1/10* (2006.01)

(52) U.S. Cl.
CPC ..... *B66C 1/102* (2013.01)
USPC ..... 294/81.53; 294/81.21

(58) Field of Classification Search
CPC .... B66C 1/663; B66C 1/101; B65D 90/0013; B66F 9/186
USPC ..... 294/81.53, 81.21, 81.1, 81.2, 81.4, 294/81.54
See application file for complete search history.

(56) References Cited

U.S. PATENT DOCUMENTS 3,713,556 A 1/1973 Tredray
4,358,020 A 11/1982 Thiele (Continued)

FOREIGN PATENT DOCUMENTS

CN 1361747 A 7/2002
CN 1457316 A 11/2003
CN 1625525 A 6/2005
GB 1379889 1/1975
JP 10-218549 A 8/1998

(Continued)

OTHER PUBLICATIONS

Extended European Search Report and Search Opinion received for EP Patent Application No. 11737357.1, mailed on May 27, 2013, 7 pages.

(Continued)

*Primary Examiner* — Gregory Adams
*Assistant Examiner* — Gabriela Puig
(74) *Attorney, Agent, or Firm* — Morrison & Foerster LLP

(57) ABSTRACT

A container yoke for lifting of at least one container, including a base frame, two travelling beams, which are telescopically displaceable in the base frame and on whose outer end portions are arranged transverse beams provided with locking members, so called twist locks, for engagement in, and locking to, the corner boxes of a container. The container yoke includes cables arranged to displace a respective travelling beam into the desired position in the frame of the container yoke. The cables, for displacement of a travelling beam, are simultaneously reeled up and unreeled with the aid of one and the same cable drum. Two cable drums of the container yoke are driven by a common actuator, and the cables are fastened in the end portion of a respective travelling beam via spring-loaded cable tensioners.

5 Claims, 7 Drawing Sheets

(56) References Cited

U.S. PATENT DOCUMENTS

| | | | | |
|---|---|---|---|---|
| 4,630,855 | A * | 12/1986 | Bjurling | 294/81.21 |
| 5,007,791 | A * | 4/1991 | Boughton | 414/494 |
| 7,152,895 | B1 * | 12/2006 | Jussila et al. | 294/81.53 |
| 8,226,137 | B2 * | 7/2012 | Kasper et al. | 294/81.56 |

FOREIGN PATENT DOCUMENTS

| | | | |
|---|---|---|---|
| JP | 11-292455 | A | 10/1999 |
| WO | 81/03323 | A1 | 11/1981 |
| WO | 01/05696 | A1 | 1/2001 |
| WO | 01/62657 | A1 | 8/2001 |
| WO | 03/037775 | A1 | 5/2003 |

OTHER PUBLICATIONS

International Preliminary Report on Patentability received for PCT Patent Application No. PCT/SE2011/050026, mailed on Jul. 26, 2012, 8 pages.

International Search Report and Written Opinion received for PCT Patent Application No. PCT/SE2011/050026, mailed on Mar. 21, 2011, 11 pages.

Office Action received for Chinese Patent Application No. 201180006141.9, mailed on Feb. 19, 2014, 13 pages.

Office Action received for European Patent Application No. 11737357.1, mailed on Jan. 31, 2014, 6 pages.

* cited by examiner 3b
14b
11a
10b
14a
15a
2
Extension
14c
11b
15b
14d
Retraction
System for one travelling beam

CABLE-CONTROLLED CONTAINER YOKE

CROSS REFERENCE TO RELATED APPLICATIONS

This is a U.S. National Phase patent application of PCT/SE2011/050026, filed Jan. 12, 2011, which claims priority to the Swedish Patent Application No. 1050028-8, filed Jan. 14, 2010, each of which is hereby incorporated by reference in the present disclosure in its entirety.

TECHNICAL FIELD

The present invention relates to a cable-controlled container yoke intended for guidance toward, locking to and lifting of at least one container. The invention especially relates to a container yoke having two telescopically displaceable travelling beams, so that containers of different lengths can be lifted with one and the same container yoke and in which the travelling beams, arranged in the frame of the yoke, are displaced to the correct position with the aid of cables/wires.

BACKGROUND ART

A large part of all the freight which is transported in the world is currently transported with the aid of containers. Loading and unloading of containers is often realized with the aid of trucks, cranes, etc. and with specially adapted lifting devices, so-called container yokes. It is important that these container yokes can be quickly adjusted to different container sizes, so that the handling of the containers is time-effective. This adjustment is normally realized with the aid of hydraulic or chain-driven systems.

A drawback with hydraulic systems is that they sooner or later begin to leak hydraulic oil, which contaminates both containers and terminals. This leads to the terminal companies in many countries being forced to pay substantial fines for oil running down in the runoff water. Hydraulic systems are also based on the continuous running of hydraulic pumps, which means higher energy consumption and that the noise level is disturbing in the terminal and for its surroundings.

Chain-driven systems have the drawback that they regularly have to be lubricated and adjusted/tensioned and that they also generate a great deal of mechanical hubbub. Moreover, a chain is less flexible and less stretchable and totally rigid in the lateral direction, which means that the truing of the chain system in the lateral direction is very sensitive and calls for narrow tolerances. This is a problem in an environment in which the container yokes are subjected to large, and, not infrequently, sudden mechanical stresses in the form of shocks and bangs.

Container yokes according to the prior art are relatively expensive to produce and to use and adversely affect the environment and, moreover, are relatively sensitive to mechanical stresses. For these reasons, it is desirable to, as far as possible, diverge from this prior art and replace it with better solutions which are quieter, cleaner, cheaper, more energy efficient and more resistant to mechanical stresses. The prior art within the field does not satisfactorily solve these problems.

DISCLOSURE OF INVENTION

One object of the invention is to solve the above-stated problems and to provide a container yoke, of the type stated in the introduction, which in a faster, simpler and cheaper manner, and without risk of oil spillage, can adjust the position of the travelling beams in the yoke, so that the container yoke can be quickly and easily adapted to a certain container size, regardless of the particular size/length of the container.

A further object of the invention is that the adjustment of the positions of the travelling beams in the frame shall be realized with the aid of cables/wires.

Another object of the invention is that the feed-in and feed-out of the cables is preferably realized with the aid of an electric motor, and preferably with the aid of a mechanical gear.

Yet another object of the invention is that each travelling beam is governed by an own individual cable and that this cable is unreeled from and reeled onto an own individual cable drum.

A further object of the invention is that all cable drums of the yoke rotate synchronously via a common axle.

Another object of the invention is that the cables, as far as possible, lie protected inside within the frame of the container yoke.

A further object of the invention is that the fastening of the cables in the travelling beams is flexible and spring-loaded, so that any slack in the wire system is effectively taken up.

The aforementioned and other objects and advantages are achieved according to the invention by a device according to the distinguishing features defined in the characterizing part of Patent claim 1.

The invention thus relates to a cable-controlled container yoke comprising a steel base frame and two individually telescopically extensible travelling beams placed therein. The movements of the travelling beams are directed oppositely to one another and these can be easily extended by the user/driver into the desired position by the use of a purpose-fitted actuator, so that the yoke can grip containers of different length, usually having one of the lengths 20, 30, 40 or 45 foot. If a 20 foot long container is to be lifted, both travelling beams are retracted fully into their inner end position, and if a 45 foot container is to be lifted, both travelling beams are maximally extended into their outermost end position. When containers measuring between 20 and 45 foot are lifted, the travelling beams are extended a predefined distance out of the frame. At each predefined position detectors are arranged, which detectors detect the travelling beam. The driver thus aligns the container yoke, the travelling beams and the locking members, so-called twist locks, arranged on the outer transverse beams of the container yoke, into engagement with the corner boxes of the container, for example with the aid of mechanical search arms arranged on or close to the four outer corners of the yoke. The locking members of the yoke are subsequently lowered into cutouts in the corner boxes of the container, after which the locking mechanism is turned a quarter turn and thus locks the yoke to the container, whereafter the container can be lifted. The electrical energy and the control signals which need to be supplied to the yoke and its actuators and detectors are preferably transmitted to the container yoke via electric cables.

The displacement of the travelling beams within the frame is effected by a cable system essentially consisting of two cables for each travelling beam. One cable is used for extension of the travelling beam and the other cable for retraction of the travelling beam.

The present invention is cheaper to produce, more energy efficient to use and is quieter during operation. Moreover, the invention is more environmentally friendly and cannot leak hydraulic oil and, furthermore, is easier to regulate and maintain.

Further distinguishing features and advantages of the invention emerge from the following, more detailed, description of the invention and from the appended drawings and the remaining patent claims.

BRIEF DESCRIPTION OF DRAWINGS

The invention is described in greater detail below in a small number of preferred illustrative embodiments, on the basis of the appended drawings.

MODE(S) FOR CARRYING OUT THE INVENTION

The invention relates to a cable-controlled container yoke 1 consisting of a base frame 2 and two individually and telescopically extensible travelling beams 3*a,b* placed therein. The movements of the travelling beams 3*a,b* are directed oppositely to one another and these can be extended into the desired position by the use of a purpose-fitted actuator 4, so that the container yoke 1 can grip containers 5 of different length.

Figure 1:
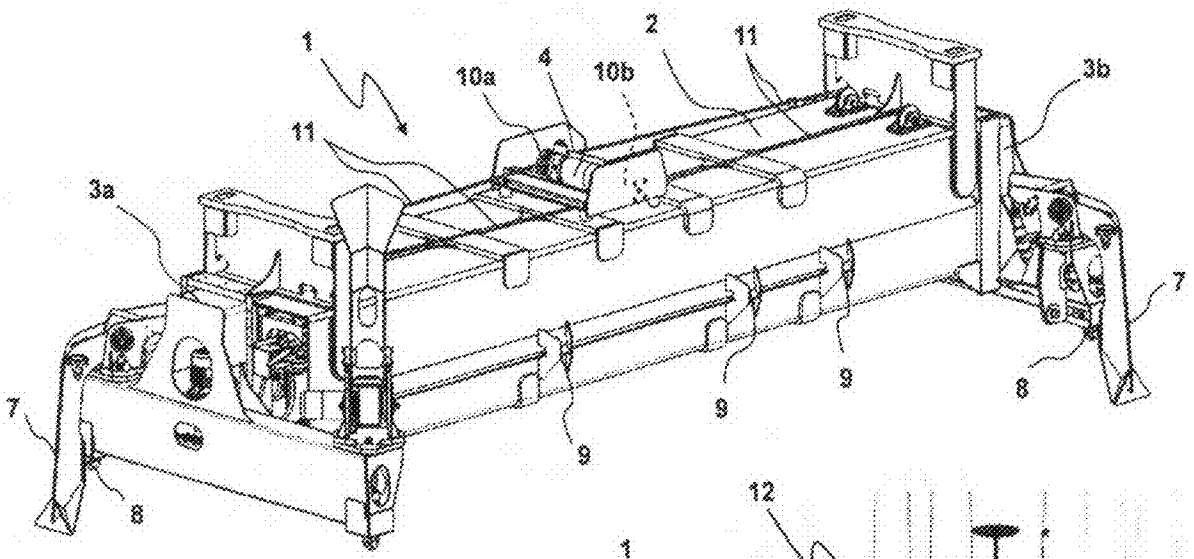
FIG. 1 shows a perspective view, obliquely from above, of a cable-controlled container yoke according to the invention.

FIG. 1 shows a perspective view of a cable-controlled container yoke 1 according to the invention, consisting of a base frame 2 in which two travelling beams 3*a,b* are displaceably arranged. On the outer end portion of each travelling beam 3*a,b* is arranged a transverse beam 6*a,b*, on whose outer corners are arranged mechanical search arms 7 and locking members 8, so-called twist locks. Position detectors 9 for detecting the positions of the travelling beams 3*a,b* are arranged along the sides of the frame 2. On the top side of the frame 2 is arranged an actuator, for example an electric motor 4, which, via a gear (not shown), synchronously drives two cable drums 10*a,b* for the unreeling and reeling of cables 11.

Figure 2:
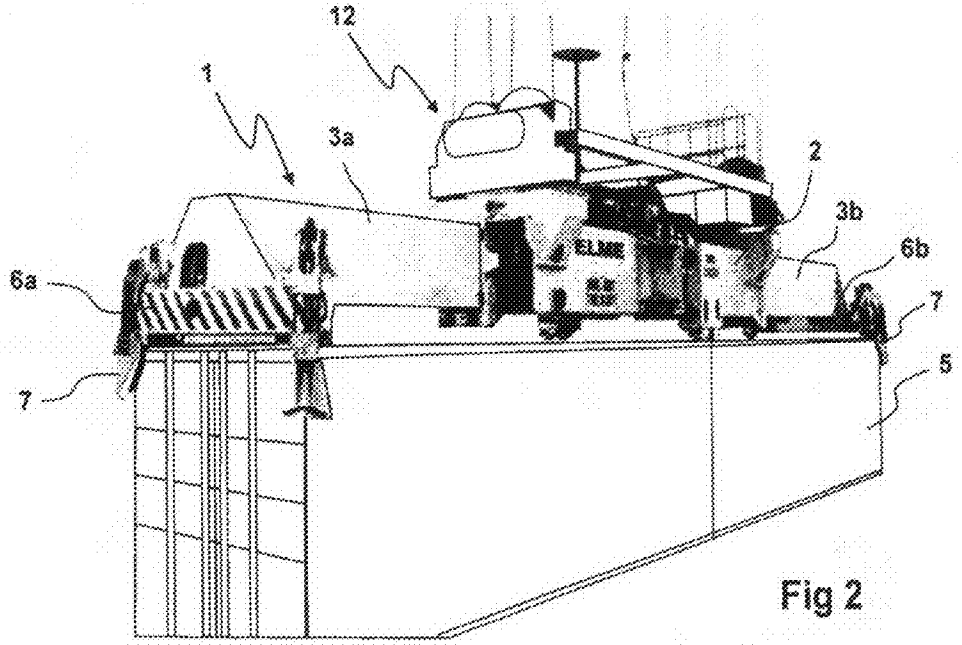
FIG. 2 shows a picture of how a crane-mounted container yoke lifts a container.

FIG. 2 shows how the container yoke 1, for example, can be mounted on a crane (not shown) with the aid of a "head block" 12 suspended from the cables of the crane. In the corners of the head block 12 are arranged locking members (not shown), by means of which the head block 12 is locked in place on the container yoke 1.

Figure 3:
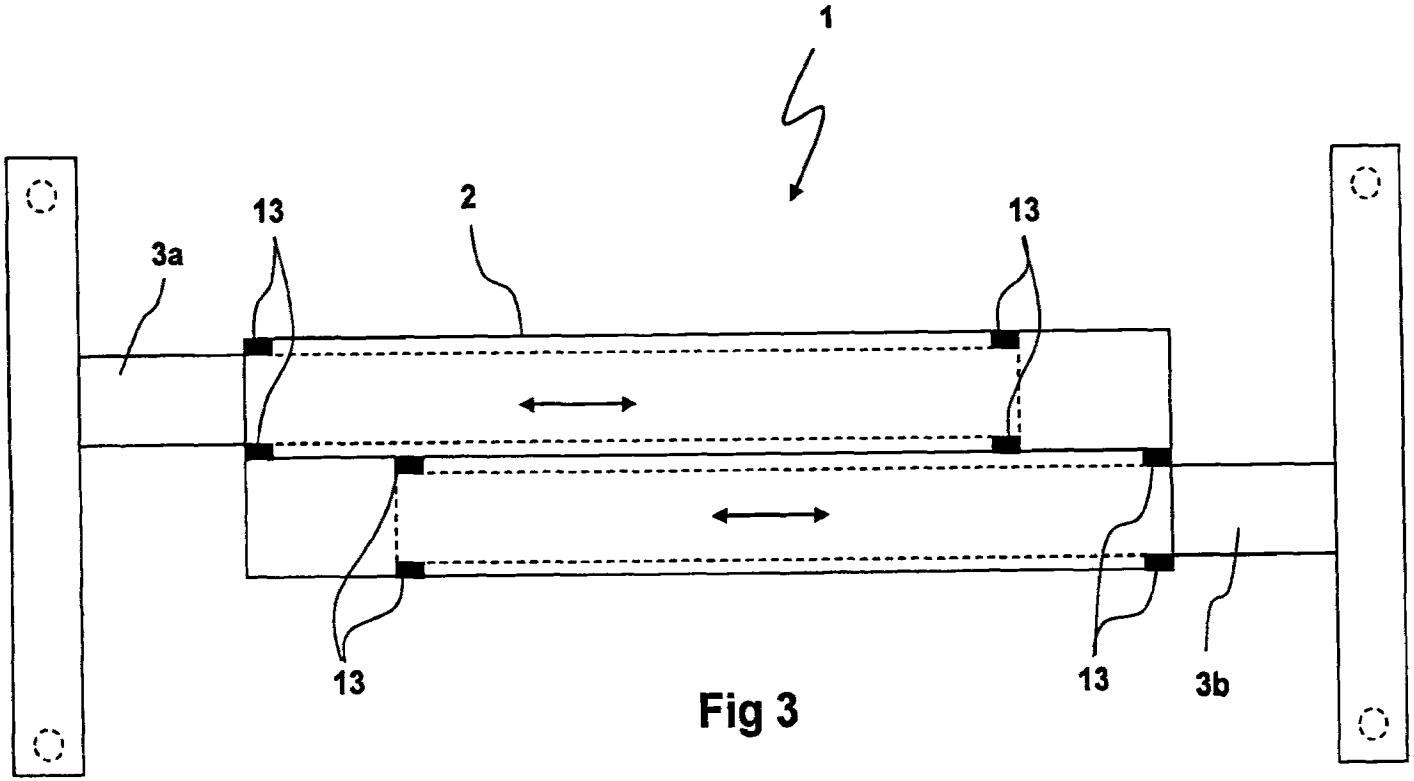
FIG. 3 shows a schematic diagram from above of the container yoke according to FIG. 1 with partially extended travelling beams.

FIG. 3 shows a basic diagram, from above, of the container yoke 1 according to FIG. 1, with partially extended travelling beams 3*a,b*. The travelling beams 3*a,b* slide in the frame 2 with the aid of bearing blocks 13.

Figures 4, 5, 6:
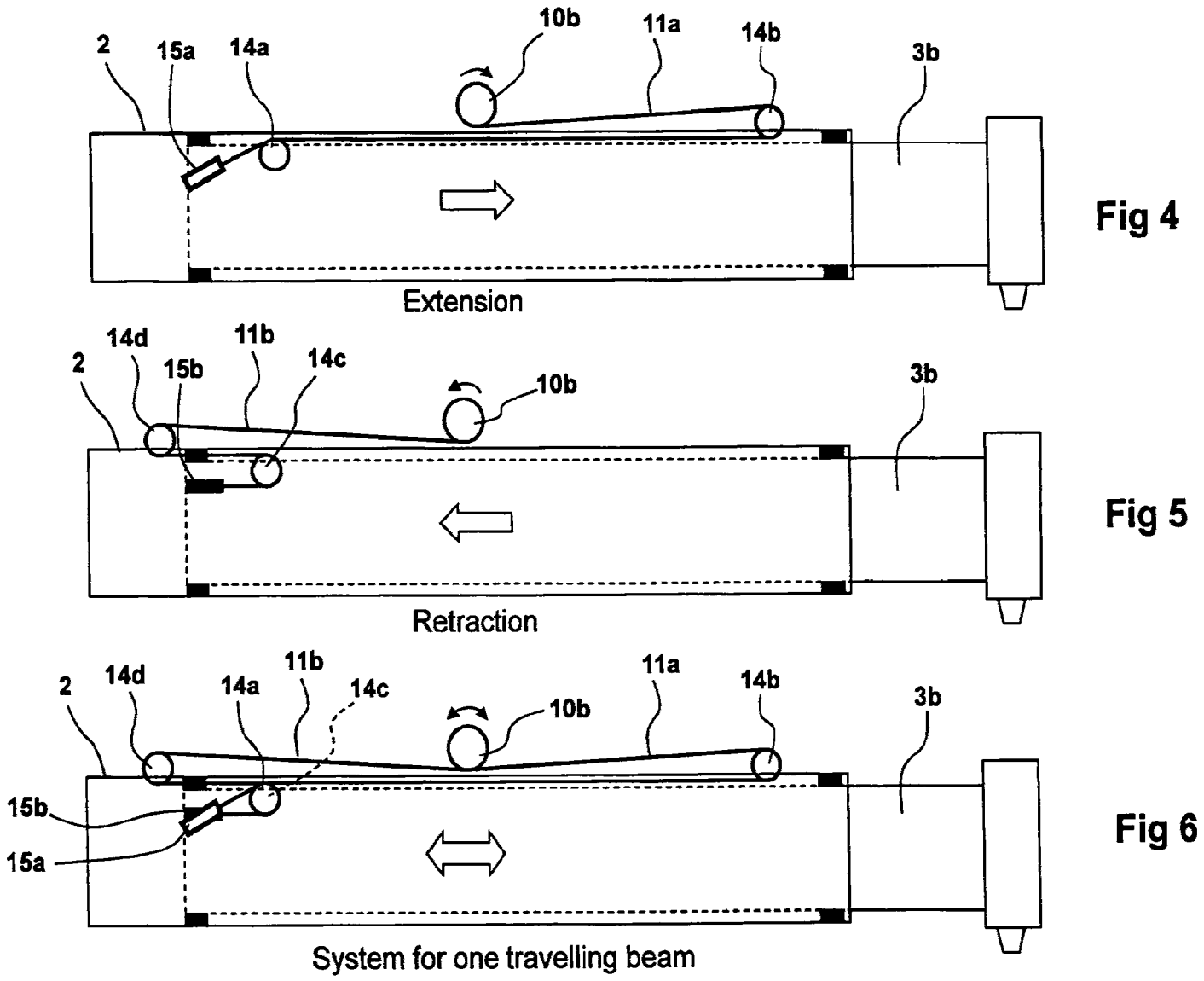
FIG. 4 shows schematically from the side a section through the frame of the container yoke and one of the travelling beams, and in which the devices for the mechanical extension of the travelling beam out of the frame in the longitudinal direction thereof, i.e. to the right in the figure, are illustrated.
FIG. 5 shows schematically from the side the same section as in FIG. 4, through the frame of the container yoke and one of the travelling beams, in which devices for the mechanical retraction of the travelling beam, to the left in the figure, have been illustrated.
FIG. 6 shows schematically from the side the same section as in FIGS. 4 and 5, through the frame of the container yoke and one of the travelling beams, and in which all devices for the mechanical movement of the travelling beam, both inward and outward, have been illustrated.

FIG. 4 shows schematically and from the side a section through the frame 2 of the container yoke and through one of the travelling beams 3*b*, and in which a first and a second deflection pulley 14*a,b* and a cable drum 10*b*, mechanically coupled to the electric motor 4, are arranged to produce a mechanical tensile force via a first cable 11*a* which pulls the travelling beam 3*b* out of the frame 2 in the longitudinal direction thereof, i.e. to the right in the figure. The cable 11*a* is at its one end fastened in the end portion of the travelling beam 3*b* preferably with spring preload, via a first cable tensioner 15*a*, and at its other end the cable is wound up onto the cable drum 10*b* driven by the electric motor 4 via a gear (not shown). The first cable 11*a* runs substantially inside the frame 2 between the upper limit wall of the frame and the upper limit wall of the travelling beam 3*b* and runs via a first and a second deflection pulley 14*a,b*. The first deflection pulley 14*a* is arranged in the travelling beam 3*b* and the second deflection pulley 14*b* is arranged in the frame 2. Cutouts are arranged in the travelling beam 3*b* and in the frame 2 close to the deflection pulleys 14*a,b*, to allow the cable to pass through the material.

FIG. 5 shows schematically and from the side the same section as in FIG. 4, through the frame 2 of the container yoke and one of the travelling beams 3*b*, in which devices for the mechanical retraction of the travelling beam 3*b* in the frame 2, i.e. to the left in the figure, have been illustrated. A second cable 11*b* is here arranged in a second spring-loaded cable tensioner 15*b*, which is also fastened in the inner end portion of the travelling beam 3*b*, and at its other end the cable 11*b* is wound up onto said drum 10*b* driven by the electric motor 4. The second cable 11*b* runs substantially inside the frame 2 between the upper limit wall of the frame 2 and the upper limit wall of the travelling beam 3*b* and runs via a third and a fourth deflection pulley 14*c,d*. The third deflection pulley 14*c* is arranged in the travelling beam 3*b* and the fourth deflection pulley 14*d* is arranged in the frame 2. Cutouts are arranged in the travelling beam 3*b* and in the frame 2 close to the deflection pulleys 14*c,d*, to allow the cable 11*b* to pass through the material.

FIG. 6 shows schematically from the side the same section as in FIGS. 4 and 5, through the frame 2 of the container yoke and one of the travelling beams 3*b*, and shows all devices for the mechanical movement of the travelling beam 3*b* in both directions. The deflection pulley 14*c* is placed behind, and hidden by, the deflection pulley 14*a*.

Figure 7:
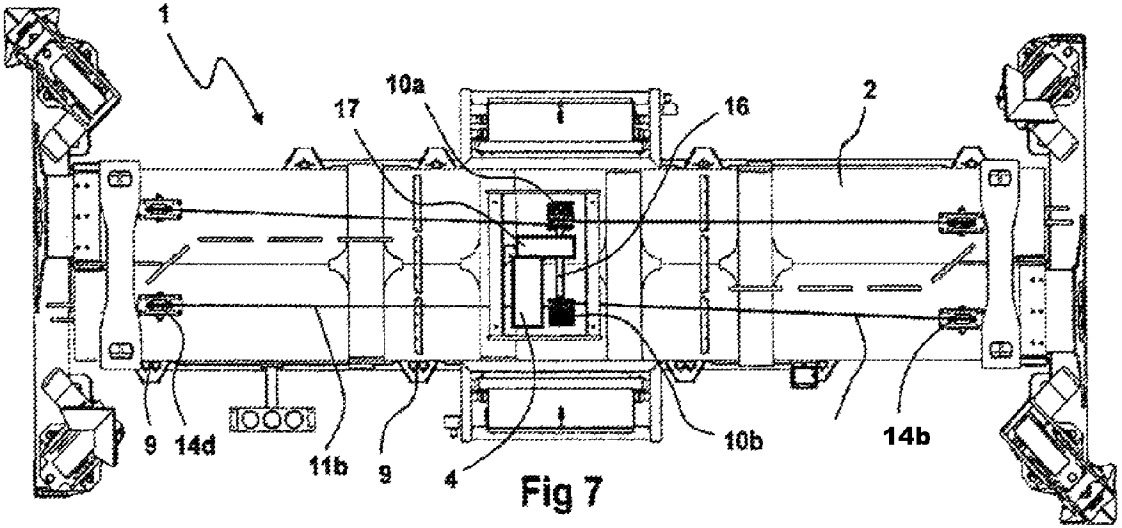
FIG. 7 shows in a view from above, in greater detail, a container yoke according to the invention, and in which the actuators, the cables and the deflection pulleys for the displacement of the travelling beams can be seen.

FIG. 7 shows in a view from above, and in closer detail, a container yoke 1 according to the invention, and in which the cable drums 10*a,b*, the cables 11 and the deflection pulleys 14*d* for the displacement of the travelling beams 3*a,b* can be seen. An electric motor 4 drives an axle 16, common to the drums, via a mechanical gear 17. The deflection pulleys 14*b,d* are mounted on the frame 2 and placed over, and partially in, cutouts in the frame 2 which allow the cables 11 to pass through the material of the frame 2.

Figure 8:
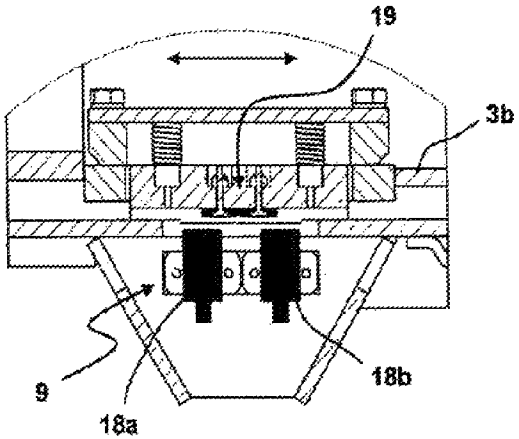
FIG. 8 shows, viewed from above, a section through a position detector.

FIG. 8 shows, viewed from above, a section through a position detector 9. Each position detector 9 comprises, for example, two inductive sensors 18*a,b* placed in the frame 2 one after the other in the motional direction of the travelling beam 3*a,b* and for each position which the travelling beam 3*a,b* might adopt. When the indicator 19 mounted on the travelling beam 3*a,b* reaches the first sensor 18*a*, a control signal is transmitted to a control electronics (not shown in detail), for example a PLC (Programmable Logic Controller), which lowers the motional speed of the travelling beam 3*a,b*. When the second sensor 18*b* detects the presence of the indicator 19, the displacement is stopped. If the container yoke 1 receives an unintentional mechanical shock and one or both travelling beams 3*a,b* is/are displaced from its/their position, the travelling beams 3*a,b* are automatically guided slowly back, by the PLC, until both sensors 18*a,b* detect the indicator 19 again. The PLC controls which position detector 9 shall stop the travelling beams 3*a,b*, i.e. which longitudinal setting for the yoke 1 has been chosen by the operator.

Figure 9:
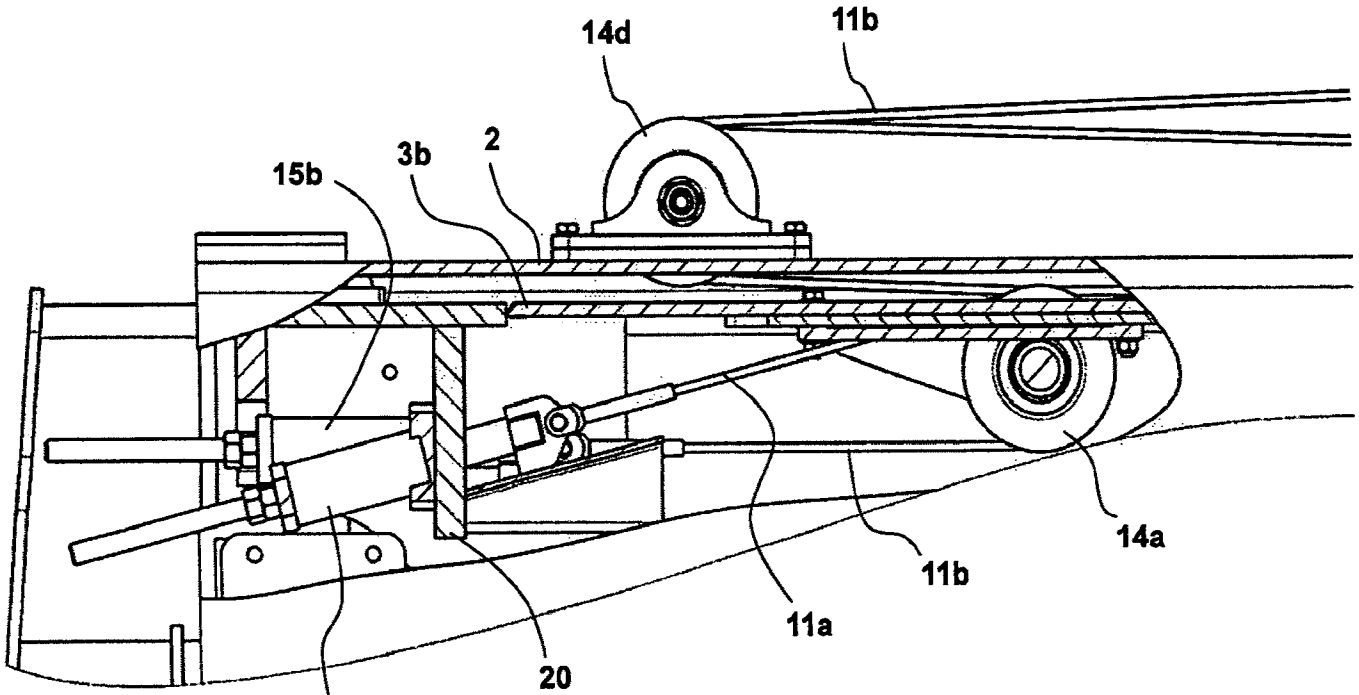
FIG. 9 shows a section through one travelling beam and, in closer detail, the fastening of the cables in the end portion of the travelling beam.

FIG. 9 shows a section through a part of one travelling beam 3*b* and, in closer detail, the fastening of the cables 11*a,b* in the end portion of the travelling beam 3*b*. Each cable 11*a,b* is here fastened in the travelling beam 3*b* via a spring-loaded cable tensioner 15*a,b*, which, in turn, is mechanically arranged in the travelling beam 3*b* via, for example, a purpose-fitted, vertically placed bracket 20. The cable tensioners 15*a,b* are shown here in their resting or starting positions and are thus compressed and rigid in the direction of pull of the cables 11*a,b*. This means that no play arises when the travelling beam 3*b* will begin to be displaced in any direction. When the travelling beam 3*b*, for example, is to be extended out of the frame (to the right in the figure), one cable 11*a* will pull the beam, while the other cable 11*b* will slacken, which leads to a certain slack in the cable 11*b*. This can cause the cable 11*b* to jump out of, or slip out of one or more deflection pulleys 14*a,b*, resulting in an operating stoppage for the container yoke. The fact that the cable tensioner 15*b*, when there is slack in the cable, is arranged to expand with the aid of a built-in spring means that the slack is eliminated and the cable 15*b* is securely detained in the deflection pulleys 14*a,b*.

In the case of a chain drive, corresponding problems do not arise, since the chain per se is sufficiently rigid in both directions for stretching or slack to be able to arise. However, a chain drive gives rise to other drawbacks, as stated above.

Figure 10A:
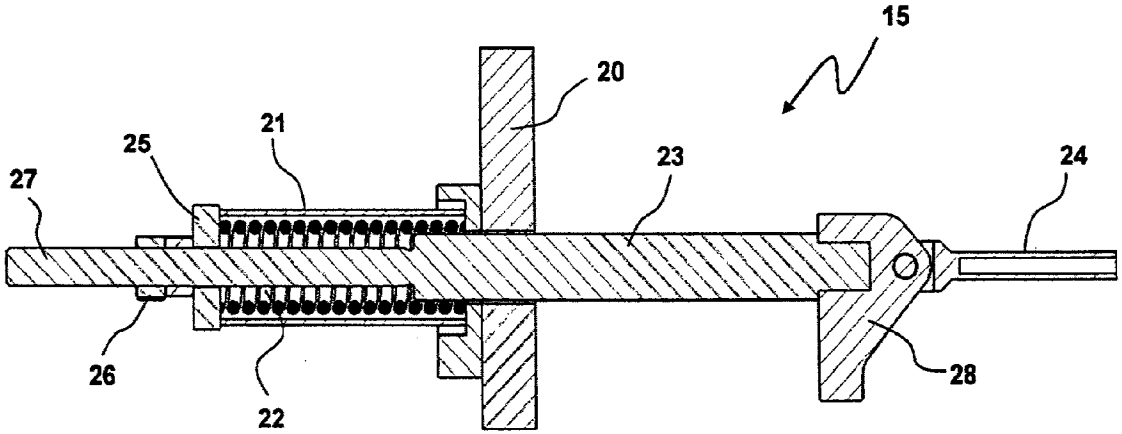
FIG. 10*a* shows from the side a section through a cable tensioner according to the invention in the compressed state.

FIG. 10*a* shows from the side a section through a cable tensioner 15 according to the invention in the compressed and active state. The cable tensioner 15 substantially consists of a tubular housing 21, in which a preloaded spring 22 is arranged. The housing 21 rests against the bracket 20. Arranged coaxially with the housing 21, and the spring 22, is a rod 23, which is displaceable in its longitudinal axis and at one, first end of which is arranged a cable fastening 24 and at the other end of which is arranged a support washer 25 which rests against the outer end portion of the spring 22. The support washer 25 can be adjusted in the longitudinal direction of the rod 23 with the aid of a nut 26 and a threaded part 27 of the rod 23, so that the cable of the container yoke 1 can be tensioned in the desired manner. That position of the line tensioner 15 which is shown in the figure is its rigid starting position, i.e. when the connected cable is tensioned/stretched. The support washer 25 thus bears against the housing 21. When the cable is subjected to a tensile force, for example for displacement of the travelling beam, this cable is stretched somewhat, whereupon the other, non-loaded cable slackens somewhat. The cable tensioner for the slackening cable thus expands with the aid of the preloaded spring 22 and compensates for the slack, so that the cable does not slip out of any deflection pulley. At the first end of the rod 23 is arranged a control element 28, whose function is to prevent the rod 23 of the cable tensioner 15 from rotating during operation.

Figure 10B:
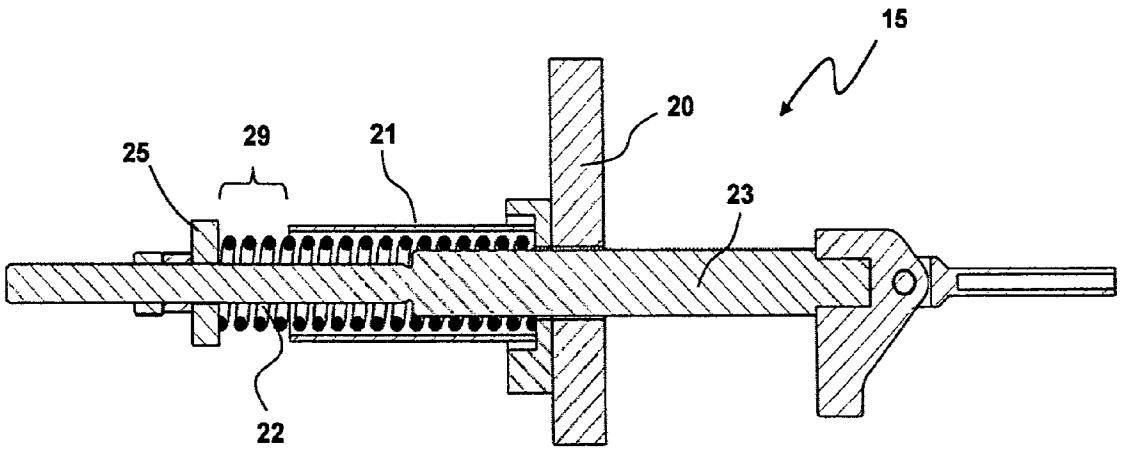
FIG. 10*b* shows from the side a section through a cable tensioner according to the invention in the expanded state.

FIG. 10*b* shows the cable tensioner 15 in the expanded state, in which a slack in the cable has been taken up, compensated for, by the cable tensioner 15, by virtue of the spring 22 having displaced the support washer 25 to the left in the figure by a distance 29 corresponding to the slack in the cable.

Figure 11:
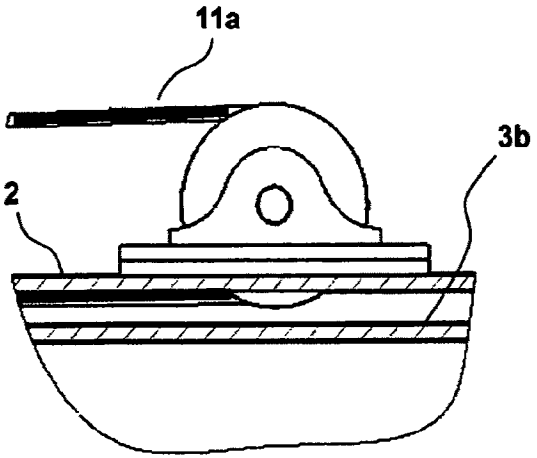
FIG. 11 shows from the side a part of a section through the frame and the travelling beam and, in greater detail, a deflection pulley arranged on the top side of the frame, and how the cable runs between the travelling beam and the frame.

FIG. 11 shows from the side a part of a section through the frame 2 and the travelling beam 3*b* and, in greater detail, a deflection pulley 14*b* arranged on the top side of the frame 2, and how the cable 11*a* runs through the material of the frame 2 and between the travelling beam 3*b* and the frame 2.

Figure 12:
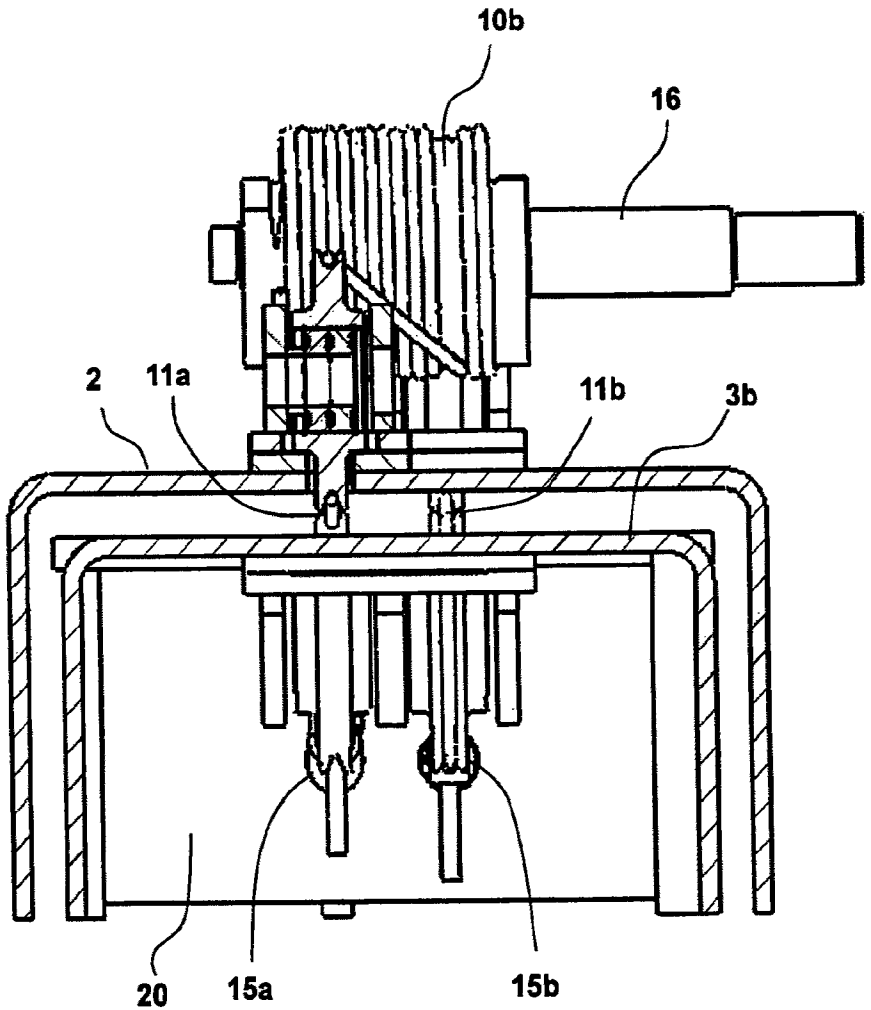
FIG. 12 shows a cross section through the frame and a travelling beam.

FIG. 12 shows a cross section through the frame 2 and a travelling beam 3*b*. In the figure it can be seen how the cables 11 are fastened via cable tensioners 15*a,b* in a bracket 20 arranged in the end portion of the travelling beam 3*b* and how the cables 11, to a considerable extent, run between the travelling beam 3*b* and the frame 2. At the same time as a cable is unreeled from the cable drum 10*b*, another cable is reeled up onto the same cable drum 10*b*. The cable drum 10*b* is driven by an axle 16, which is common to the other cable drum 10*a* which guides the cables 11 for the other travelling beam 3*a* of the container yoke 1.

The description above is primarily intended to facilitate understanding of the invention. The invention is therefore, of course, not limited to the specified embodiments, but rather other variants of the invention are also possible and conceivable within the scope of the inventive concept and within the scope of protection of the following patent claims.

The invention claimed is:

1. A container yoke for lifting of at least one container, comprising:

a base frame, two travelling beams, which are telescopically displaceable in the base frame and on whose outer end portions are arranged transverse beams provided with locking members for engagement in, and locking to, the corner boxes of a container, characterized in that cables are arranged to displace a respective travelling beam into the desired position in the frame of the container yoke, in that the cables, for displacement of a travelling beam, are arranged to be simultaneously reeled up and unreeled with the aid of one and the same cable drum, in that both cable drums of the container yoke are arranged to be driven by a common actuator, in that the cables are fastened to the end portion of a respective travelling beam via spring-loaded cable tensioners, and in that at least a part of the cables runs between the travelling beam and the frame and that at least another part of the cables is disposed above the frame.

2. The container yoke as claimed in claim 1, characterized in that the actuator is an electric motor.

3. The container yoke as claimed in claim 1, characterized in that the cable drums arranged to rotate synchronously via a common axle.

4. The container yoke as claimed in claim 1,
characterized
in that the cable tensioner is arranged to eliminate any slack in the connected cable with the aid of a preloaded spring.

5. The container yoke as claimed in claim 1,
characterized
in that the cables for each travelling beam are arranged to be reeled or unreeled via a single cable drum.

* * * * *